US006663452B1

(12) United States Patent
Myers

(10) Patent No.: US 6,663,452 B1
(45) Date of Patent: Dec. 16, 2003

(54) AQUATIC FINS

(76) Inventor: Robert J. Myers, 2701 E. Hammer La., #110, Stockton, CA (US) 95210

( * ) Notice: Subject to any disclaimer, the term of this patent is extended or adjusted under 35 U.S.C. 154(b) by 0 days.

(21) Appl. No.: 10/278,632

(22) Filed: Oct. 22, 2002

(51) Int. Cl.[7] ..... A63B 31/11
(52) U.S. Cl. ..... 441/64
(58) Field of Search ..... 441/55, 61–64; D21/806

(56) References Cited

U.S. PATENT DOCUMENTS

| | | | | | |
|---|---|---|---|---|---|
| D266,265 | S | * | 9/1982 | Bowden | D21/806 |
| 5,421,758 | A | * | 6/1995 | Watson et al. | 441/61 |
| 5,607,334 | A | * | 3/1997 | Garofalo | 441/64 |
| 6,341,383 | B1 | * | 1/2002 | Beltrani | 2/452 |

* cited by examiner

*Primary Examiner*—Sherman Basinger
(74) *Attorney, Agent, or Firm*—Milburn & Peterson, P.C.; Robert C. Peterson

(57) ABSTRACT

An aquatic fin for propulsion of a watercraft including a foot securing section and a blade section. The blade section having a top surface forming a concavity and a bottom surface forming a convexity. The blade section and foot section are joined by side walls and struts which define channels for directing water around the convexity in order to lessen the resistance of the fin moving downwardly and rearwardly through the water and with the upwardly and forwardly movement of the fin the concavity increases the resistance through the water, thereby propelling the watercraft away from the direction the user is facing. The foot securing section including knobs having radially extending oval tips in which latch plates on each end of a cross-strap that extends across the instep of the wearer seat over the knobs and are retained in place by clips on opposed ends of a heel band extending around the heel of the wearer, locking the cross-strap and heel band from detachment from the knobs unless the clips on the heel band are rotated into orientation with the oval tips.

19 Claims, 3 Drawing Sheets

AQUATIC FINS

BACKGROUND OF THE INVENTION

1. Field

This invention relates generally to fins worn by users of pontoon boats and float tubes and more particularly to such fins as permit the user to safely and easily mount and dismount from float tubes and pontoon boats and walk around the water's edge and into the shallow water over slippery underwater obstacles and maintaining his or her balance. Further such fins provide the user the ability to maneuver a pontoon boat or float tube with his or her feet.

2. State of the Art

In the past, swim fins have been modified in various respects in attempts to aid maneuvering of water craft. Such attempts to use swim fins, however modified incur the problem of having the same water resistance in opposed directions, thus swim fins are relatively useless in trying to propel pontoon boats or float tubes while the individual is in an upright position, like standing in some float tubes or sitting in some pontoon boats or float tubes with his or her feet and legs dangling in the water. Further problems exist regarding the possibility of falling while trying to maneuver in or out of a float tube or pontoon boat, which is in shallow water, in which the wearer could slip and fall and suffer potentially serious injury or even drown, especially if the individual is in a remote area far from help.

To overcome some of these difficulties, various devices have been conceived. One such arrangement is set forth in Celik's U.S. Pat. No. 6,077,139. The fins actions are like butterfly wings that close on forward striding on dry land or river bottom, yet in deep water, rearward movement of the foot or leg propel the float tube forward in the direction the user if facing. Maneuvering in this fashion causes the float tube to move towards the casting direction of the fisherman, more readily tangling his fishing line.

Other designs such as Johnson's U.S. Pat. No. 6,227,923 B1 disclose propulsion fins, which again move the user in the direction they are facing and the propulsion devices require mechanical unlatching when in use to propel the boat. They are designed such that the user can release the fin member with the toe of one foot cover engaging the latch on the rear of the other fin member. When walking in shallow water or on dry land, the user must make sure the fin member is securely latched.

Another such design fails to have a latching mechanism and thus the fin is like a half sole shoe in which the sole has come loose at the rear and remains attached at the toe. As the fisherman move his or her legs in the water the fin resists movement rearward to propel the float tube and fold against the shoe sole with forward movement. On dry land with little or no fluid resistance, the fin tends to flap when walking. See Schneider's U.S. Pat. No. 4,664,639.

The Johnson's U.S. Pat. 6,227,923 B1 reference discloses a number of other awkward arrangements for foot propulsion of float tubes or pontoon boats. It would be recognized that in the sitting position in pontoon boats and float tubes with the individual's feet dangling in the water without some means of lessening the water resistance in one direction is essential for properly maneuvering the craft in a forward and rearward direction.

Other fins currently on the market are generally too long, heavy, uncomfortable and make it difficult to enter or exit the water craft. Many of such fins are designed strictly for propulsion and make walking in shallow water and on shore difficult and somewhat awkward and likewise somewhat susceptible to slip and fall accidents. Obviously when fishing from a pontoon boat or a float tube, it is necessary to get to the craft, which is in the water, to get in or out of the water craft and to be able to standup and walk in the water without having to remove the fins.

SUMMARY OF THE INVENTION

It is an object of the present invention to provide fins for propelling pontoon boats and float tubes, which permit the user to put on, safely walk on the shoreline into the water and get into the water craft wearing the fins, in which the blade section of the fins are angled upwardly in the forward direction to permit a reasonable walking stride for the individual without the fins causing the individual to stumble or trip. Thus permitting the wearer to readily traverse from the shoreline into the shallow water over underwater surfaces and enter the water craft with relative ease.

It is another object of the invention to provide a fin blade design, which provides the desired function to provide the maximum thrust by the upward movement or stroke of the legs and minimal resistance on the downward stroke.

It is still a further object of the invention to provide a spoon or shallow ladle design with its greatest breadth centrally or medially of the fin blade to provide maximum resistance or thrust on the upward movement of the spoon shaped fin and provide a minimum resistance on the downward movement, thus propelling the water craft forward with the person facing aft of the water craft.

It is a further feature of the fins to incorporate a sole with cleats or lugs around the periphery and a high density felt gripping pad between the cleats or lugs whereby the lugs allow the user to walk on rough and rocky surfaces and the felt reduces the risk of slipping while in or out of the water. Such arrangement provides better traction for standing and walking or wading on the bottom of a river or lake. The length of lugs and depth of the high density felt is tapered from the front to the rear to provide a more uniform and flat plane from the heel of the wearer's boot to the blade section of the fin, thus limiting any rocking motion.

It is still further a feature of the fin to provide quick release straps to secure the fin to an individual's foot or boot. A cross strap is provided with slot plates on each end, which seat over a roundish projection with a non-circular top and an adjustable heel strap with clips on each end oriented to seat over the non-circular top and rotate into position behind the wearer's heel and thus secure the cross strap and heel strap around the wearer's boot.

DETAILED DESCRIPTION OF THE PREFERRED EMBODIMENT

Figure 1:
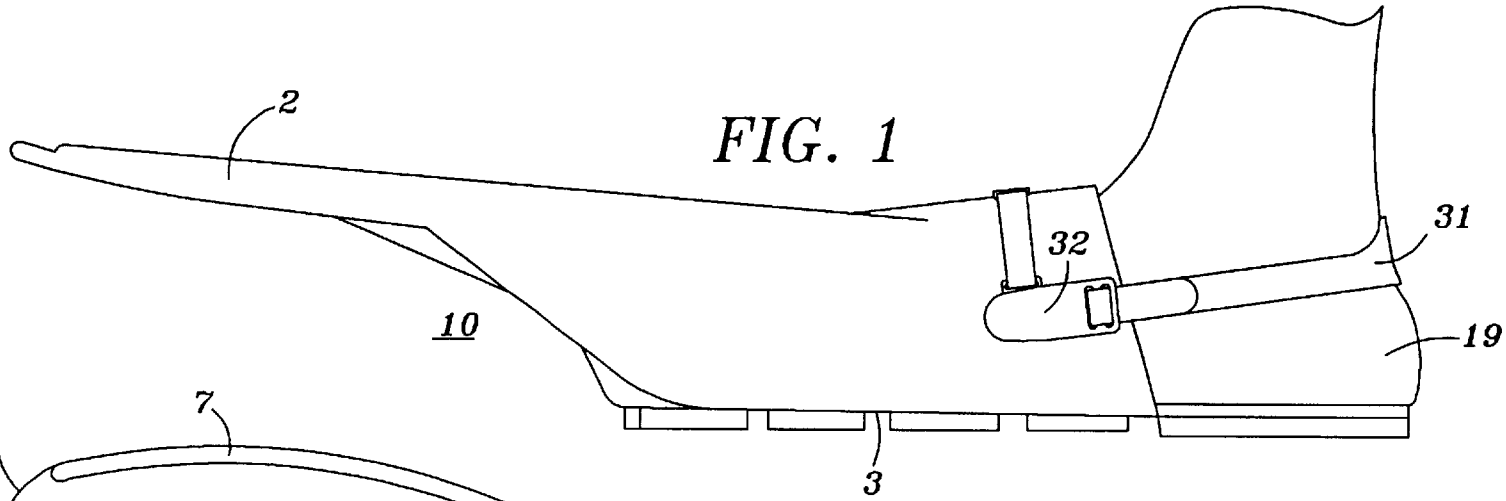
FIG. 1 side elevation view of the aquatic fin illustrating the upward angle of the fin.
Figure 2:
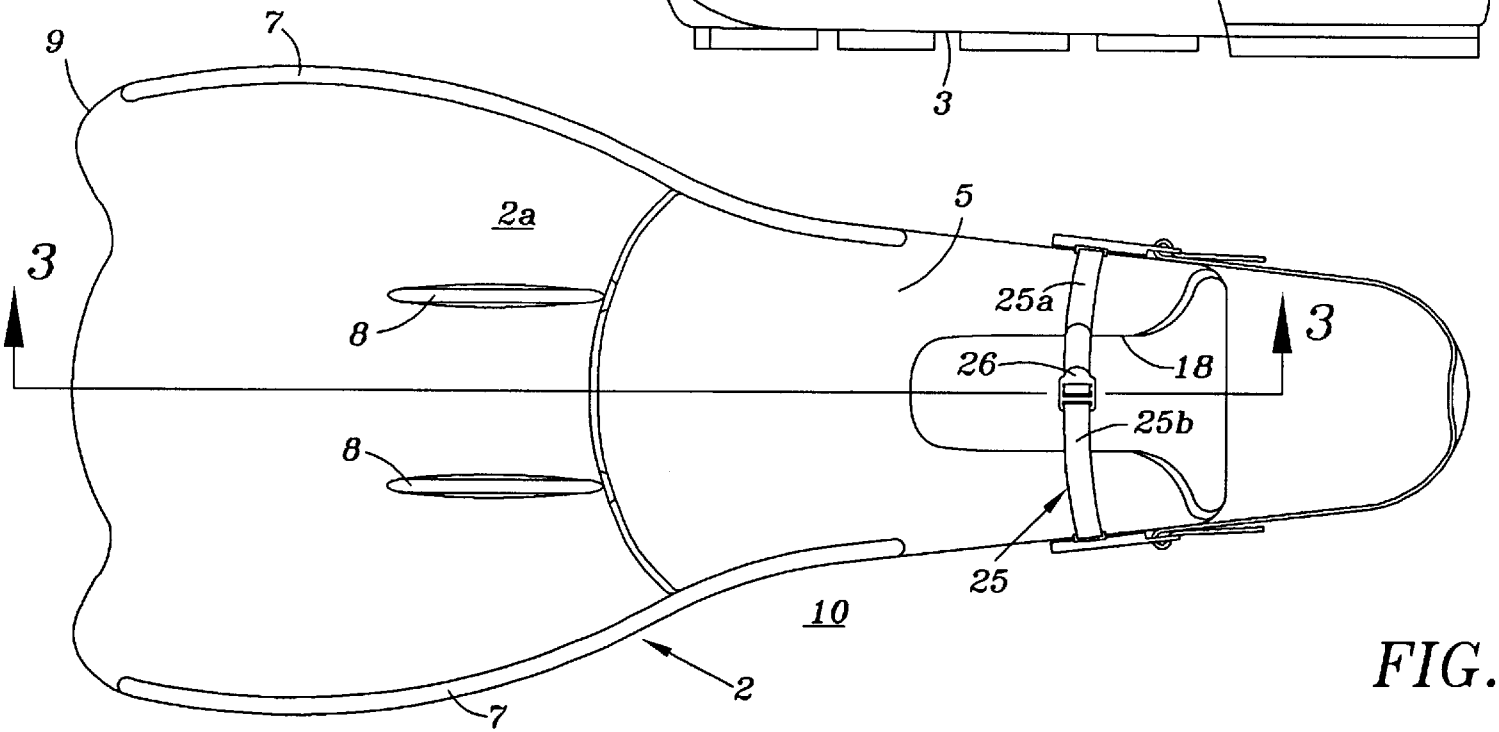
FIG. 2 is a top view of the fin illustrating the blade arrangement and belt and heel band
Figure 3:
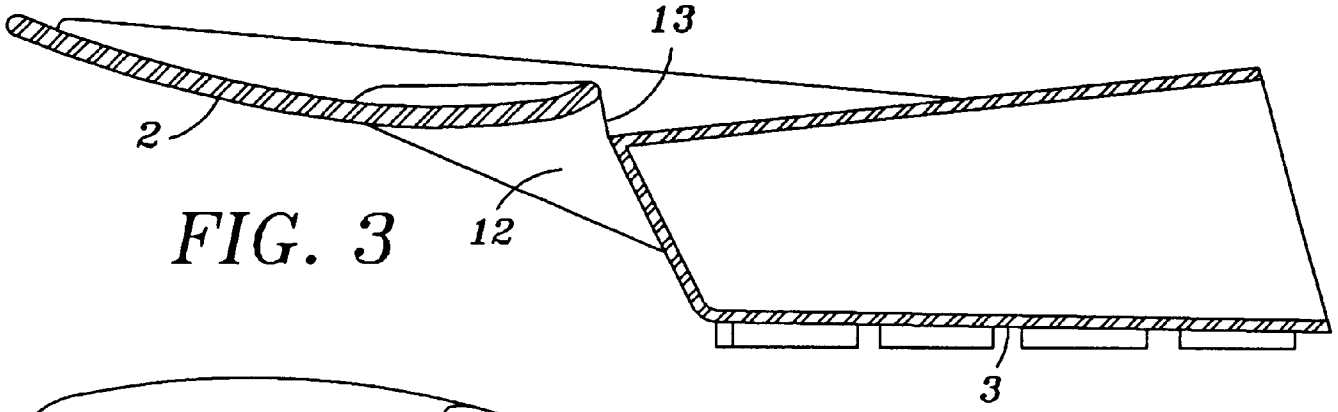
FIG. 3 is a sectional view taken along lines 3–3 in FIG. 2.
Figure 4:
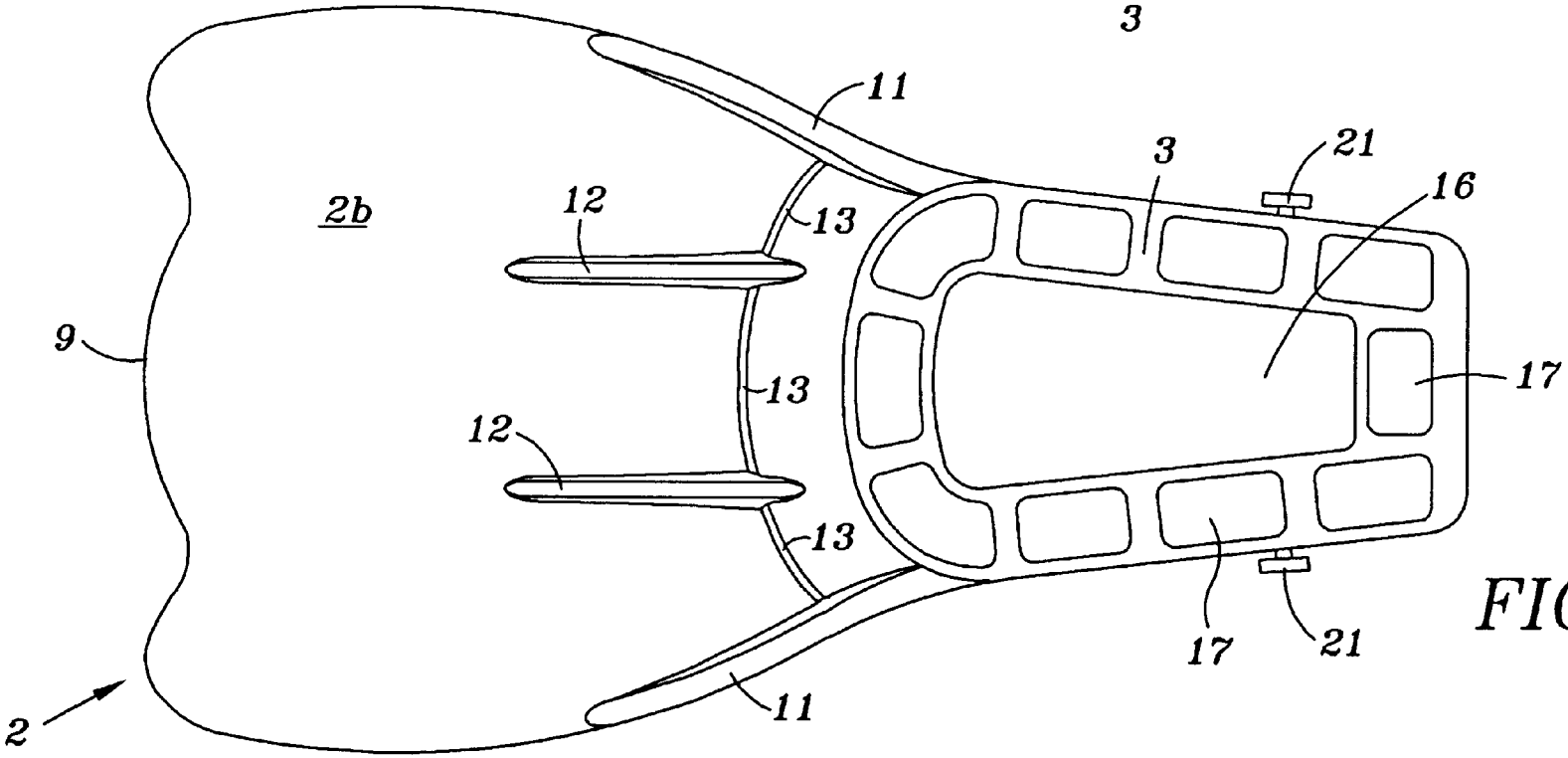
FIG. 4 is a bottom view illustrating the arrangement of the lugs and the gripping pad.
Figure 5:
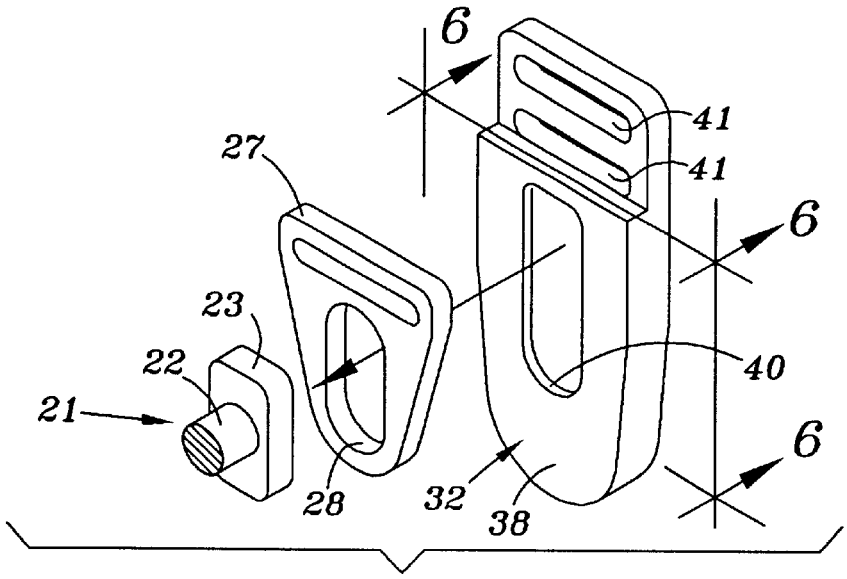
FIG. 5 illustrates in perspective, the relative positioning of the latch plate and locking buckle to the fin button.
Figure 6:
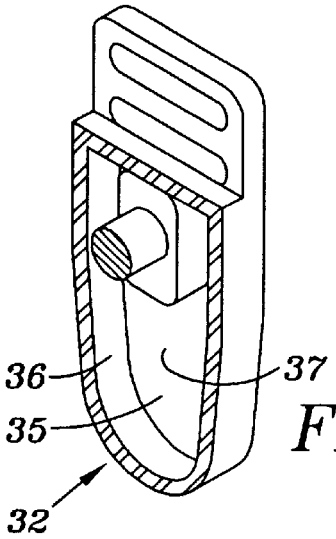
FIG. 6 is a sectional view taken along lines 6–6 of FIG. 5.
Figure 7:
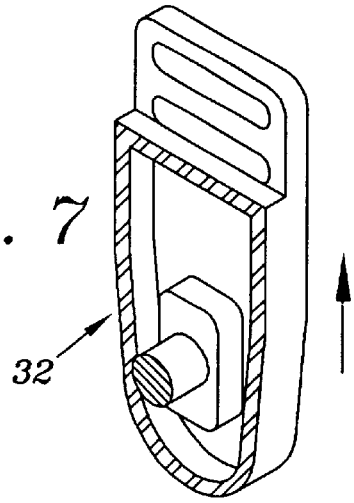
FIG. 7 shows a movement into the latching position.
Figure 8:
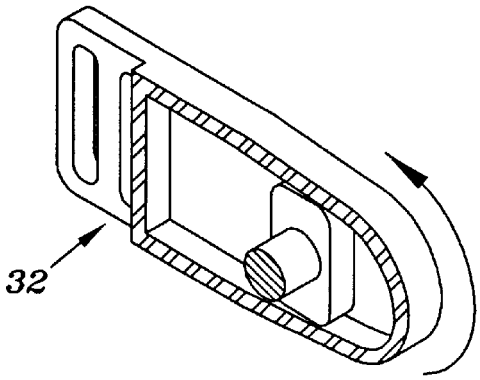
FIG. 8 shows the relative rotation to lock the latching mechanism with the heel band in place.
Figure 9:
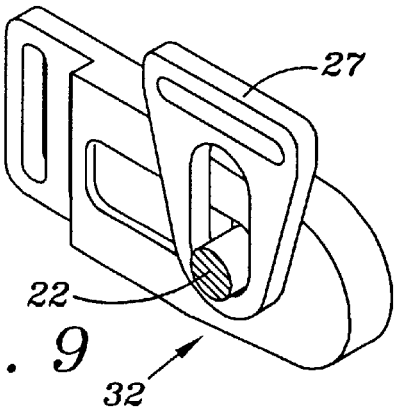
FIG. 9 illustrates in perspective, the relative position of the latch plate and locking buckle when locked.

Referring now to FIGS. 1 through 4, the fisherman's fins generally referred to by 10 has blade section 2, which is angled upwardly from the plane of sole 3. Fin 10 has foot retaining section 5 integral to blade section 2. Blade section 2 has a peripheral rib 7 on each side and two stabilizing ribs 8 as well as struts 12 (see FIG. 4), to aid in retaining blade section 2 with concavity 2*a* on the topside. The front edge 9 of blade section 2 is rippled. Referring, particularly to FIG. 4, blade section 2 has convexity 2*b*. Side walls 11 and struts 12 aid in retaining the underside of blade section 2 with convexity 2*b*. Side walls 11 and struts 12 join blade section 2 to foot retaining section 5 and also provide channels 13 for passage of water from convexity 2*b* through channels 13 to foot retaining section 5.

When the user of fins 10 is seated with his or her legs in a vertical position or a horizontal position in a watercraft, fins 10 aid in propelling the craft. When the wearer moves his or her foot forwardly and upwardly, concavity 2*a* offers more resistance to the water than encountered by convexity 2*b* when the foot is moved downwardly and rearwardly. Concavity 2*a* on the top side of blade section 2, together with peripheral rib 7 in conjunction with struts 12, maintain the rigidity of concavity 2*a* and thus provides more propulsion force on the forwardly and upwardly movement of the wearer's foot. Likewise, on the downwardly and rearwardly movement of the wearer's foot convexity 2*b* on the underside of blade section 2 disburses the water around front edge 9, peripheral ribs 7 and through channels 13 reducing the resistance of the water. Consequently, concavity 2*a* on the forward and upward movement of fin 10 through the water provides greater thrust than provided on the downward movement of fin 10 through the water due to convexity 2*b* and channels 13.

Again referring to FIGS. 1 and 4, sole 3 has central fabric gripping pad 16 attached to the center of sole 3 and sole 3 has a series of peripheral arranged lugs 17. Fabric gripping pad 16 may be secured to sole 3 with Velcro® fasteners with the loop members affixed to sole 3 and the pile section affixed to gripping pad 16 although either the pile or loops may be secured to sole 3. It should be noted that the length of cleats or lugs 17 are tapered, in descending length towards the rear from blade section 2, such that the individual wearing fin 10 would not have a tendency to rock standing on a flat, level surface.

Foot retaining section 5 has throat region 18, which accommodates insertion of wearer's foot with varying size boots 19. Each side wall 11 has button 21 having a roundish or cylindrical stem 22 integral with side walls 11 and generally radial tip or oval knob 23. In order to retain fin 10 on wearer's boot 19, belt 25 with free strap 25*a* and buckle strap 25*b* is placed over knob 23 and engages cylindrical section 22 by triangular shaped fastener or latch plate 27, which has elongated opening or slot 28 that fits over knob 23 and seats about roundish stem. Buckle strap 25*b* is secured at one end to buckle 26 and at the other end to a triangular shaped fastener 27 by nylon webbing and free strap 25*a* is made of nylon webbing and also is secured to a triangular shaped fastener 27.

Referring now in particular to FIGS. 5 through 9, heel strap 31, which is preferably made of stretch rubber, has a pair of locking buckles 32. Each locking buckle 32 has hollow interior 35 formed by side walls 36 and back wall 37 and face 38. Face 38 has elongated slot 40, which when properly oriented seats over radial tip or knob 23 and rotates about stem 22 with strap 31 positioned behind the wearer's foot or boot 19. Due to hollow interior 35, locking buckle 32 is free to rotate about stem 22 and thus position itself such that radial tip or knob 23 is crosswise to elongated slot 40. Locking buckle 32 includes slots 41, which accommodate the adjustment of heel straps 31 in slots 41.

In order for the wearer to retain fin 10 on his or her foot or boot 19, the wearer inserts his or her foot in foot retaining section 5 and hooks belt 25 with latch plates 28 positioned over button 21 on each side of fin 10 and then free strap 25*a* attached to adjustable buckle 26 may be adjusted to secure foot retaining section 5 across the wearer's foot or boot 19 expanding or contracting throat region 18. Locking buckle 32 on heel band 31 is oriented to seat over knob 23 and rotated to position heel band 31 behind the heel of boot 19. Strap 31 may be adjusted by shortening or lengthening one or both ends of heel band 31 in slots 41 of locking buckle 32. Thus it can be seen by positioning latch plates 27 over button 21 and then positioning locking buckles 32 with heel bands 31 attached, oriented with and seated over knob 23, locking buckles 32 can then be rotated to secure belt 25 and heel band 31 to fin 10 to prevent fin 10 from inadvertently coming loose form the wearer's foot or boot 19.

Although the preferred embodiment of the invention has been disclosed, it will be appreciated that various modifications will be readily apparent to those skilled in the art, however, such changes and modifications are within the scope of the invention as defined in the appended claims.

What is claimed:

1. An aquatic fin for propulsion of a watercraft comprising:

(a) a foot retaining section for maintaining the fin positioned on the user's foot;

(b) a propulsion section extending forward from the foot retaining section oriented to permit the user's normal walking gait substantially unimpeded, the propulsion section having a top and bottom defining a concavity on the top surface and a convexity on the bottom surface;

(c) a channel way between the foot retaining section and propulsion section, the channel way impeding water flow on the upward movement of the fin through water and aiding water flow through the channel way on the downward movement of the fin through the water; and (d) a sole underlying the foot retaining section, the sole having a central gripping pad for resisting slippage and peripheral studs surrounding the central gripping pad for traction.

2. The aquatic fin of claim 1, wherein the foot retaining section includes a roundish projection from each side of the foot retaining section ending in a non-circular radial top.

3. The aquatic fin of claim 2, wherein a cross-strap is attached over the non-circular radial top and a heel strap having a clip at each end seats over the non-circular radial top and rotatable into or out of an undetachable position behind the heel of the user's foot.

4. The aquatic fin of claim 2, wherein the non-circular top of the roundish projection is an oval.

5. The aquatic fin of claim 1, wherein the studs and gripping pad are tapered rearwardly from a greater to lesser depth.

6. The aquatic fin of claim 1, wherein the gripping pad is a high density felt.

7. The aquatic fin of claim 6, wherein the gripping pad does not project below the studs.

8. The aquatic fin of claim 1, wherein the foot retaining section includes a throat opening with an adjustable cross-strap extending thereover for accommodating various size boots.

9. The aquatic find of claim 1, wherein the foot retaining section includes a roundish projection from each side, having a radial terminous with a lesser length in the horizontal plane than any other.

10. The aquatic fin of claim 1, wherein the gripping pad is attached to the sole by a loop and pile fastener.

11. In an aquatic fin including an adjustable strap and an adjustable heel band for retaining the fin on a wearer's foot, the improvement comprising a quick release coupling system including:

(a) a projection extending from each side of the fin terminating in a non-circular radially extending head;

(b) the adjustable strap with a member at each end having an aperture, which seats over the head and nestles with the projection; and (c) the adjustable heel band extending about the wearer's heel terminating in a slide coupling at each end, each coupling adapted to fit over the head in a non-horizontal plane and remain undetachable while positioned in a horizontal plane of the user's foot.

12. The coupling system of claim 11, wherein the non-circular head is a radially extending oval tip oriented in a non-horizontal plane.

13. The coupling system of claim 11, wherein the member is retained in position by the slide coupling being crosswise with the non-circular head.

14. An aquatic fin for propulsion of a watercraft by a user comprising:

(a) a blade section having a spoon-shaped face upwardly slanted with the front edge fluted;

(b) a foot retention section for attachment to a wearer's boot integral with the blade section through adjoining sidewalls and struts forming channels therebetween; and (c) a sole underlining the foot retaining section, the sole having a central gripping pad for resisting slippage and peripheral studs surrounding the central gripping pad for traction.

15. The aquatic fin of claim 14, wherein the foot retention section includes a roundish protrusion with an oval terminous oriented in a non-horizontal plane on each side thereof.

16. The aquatic fin of claim 15, wherein a cross-strap is attached over the oval terminous and a heel strap having a clip at each end seats over the oval terminous and rotatable into or out of an undetachable position behind the heel of the user's foot.

17. The aquatic fin of claim 14, wherein the studs and gripping pad are tapered rearwardly from a greater to lesser depth.

18. The aquatic fin of claim 14, wherein the gripping pad is a high density felt.

19. The aquatic fin of claim 18, wherein the gripping pad does not project below the studs.

* * * * *